US007498780B2

(12) United States Patent
Chen et al.

(10) Patent No.: US 7,498,780 B2
(45) Date of Patent: Mar. 3, 2009

(54) LINEAR VOLTAGE REGULATING CIRCUIT WITH UNDERSHOOT MINIMIZATION AND METHOD THEREOF

(75) Inventors: Hung-I Chen, Kao-Hsiung (TW); Chih-Hong Lou, Yilan County (TW)

(73) Assignee: Mediatek Inc., Science-Based Industrial Park, Hsin-Chu (TW)

( * ) Notice: Subject to any disclaimer, the term of this patent is extended or adjusted under 35 U.S.C. 154(b) by 176 days.

(21) Appl. No.: 11/739,115

(22) Filed: Apr. 24, 2007

(65) Prior Publication Data

US 2008/0265853 A1 Oct. 30, 2008

(51) Int. Cl.
*G05F 1/40* (2006.01)
*G05F 1/56* (2006.01)

(52) U.S. Cl. ..... 323/273; 323/270

(58) Field of Classification Search ..... 323/268–273, 323/275, 280, 312, 315
See application file for complete search history.

(56) References Cited

U.S. PATENT DOCUMENTS 5,672,959 A * 9/1997 Der ..... 323/273
5,894,227 A 4/1999 Acuff
5,966,004 A 10/1999 Kadanka
6,201,375 B1 3/2001 Larson
6,359,427 B1 * 3/2002 Edwards et al. ..... 323/316
6,369,554 B1 * 4/2002 Aram ..... 323/282
7,402,987 B2 * 7/2008 Lopata ..... 323/282

* cited by examiner

*Primary Examiner*—Matthew V Nguyen
(74) *Attorney, Agent, or Firm*—Winston Hsu

(57) ABSTRACT

A voltage regulating circuit for providing a regulated output voltage. The voltage regulating circuit includes a voltage regulator, a converting circuit, a capacitive device, a first current mirror module, and a second current mirror module. The voltage regulator has a first output producing the regulated output voltage and a second output producing a pass voltage. The converting circuit converts the pass voltage into a first current and a second current passing through a first converting node and a second converting node respectively, where the first current charges/discharges the capacitive device. The first current mirror module has a first current mirror path coupled to the first converting node and a second current mirror path coupled to the second converting node. The second current mirror module has a first current mirror path coupled to the second converting node and a second current mirror path coupled to the first output.

18 Claims, 6 Drawing Sheets

LINEAR VOLTAGE REGULATING CIRCUIT WITH UNDERSHOOT MINIMIZATION AND METHOD THEREOF

BACKGROUND

This invention generally relates to voltage regulation, and more particularly, to a linear voltage regulating circuit with undershoot minimization and a method thereof.

A regulator, coupled between a voltage supply source and a load device, is used to provide a sufficiently constant output current to maintain the drive of a load device. When the load device undergoes a rapid load current transition, where current draw or load impedance alternates between a heavy load and light load, a typical regulator can have several shortcomings. FIG. 1 illustrates such a typical voltage regulator 100 according to the related art. This related art voltage regulator 100 suffers from an undershoot problem when the load device undergoes a rapid transition between a heavy load and light load. The voltage regulator 100 includes a pass transistor $MP_X$ coupled between a supply voltage $V_{CC}$ and an output voltage $V_{OUT}$; an amplifier $A_1$ coupled to the pass transistor $MP_X$ for controlling the response of the pass transistor $MP_X$ by comparing a reference voltage $V_{REF}$ and a feedback voltage $V_{FB}$; a feedback circuitry connected between the output node $V_{OUT}$ and the amplifier $A_1$ for delivering the feedback voltage $V_{FB}$. Additionally, the output voltage $V_{OUT}$, inducing a load current $I_{LOAD}$, is coupled to a load device modeled by a load resistor $R_{ESR}$ and a load capacitor $C_L$.

Due to loop bandwidth limitations in the load transient response of a transition from a heavy load to light load, the voltage regulator 100 is unable to turn off the pass transistor $MP_X$ in time. A large current from the $MP_X$ therefore results, and acts to immediately charge the load capacitor $C_L$ to increase the output voltage $V_{OUT}$. This forces the voltage regulator 100 to enter a voltage overload condition. Upon stabilization of the voltage overload condition through the regulator loop, the output voltage $V_{OUT}$ should still be high enough to turn off the pass transistor $MP_X$. However, the charge from the voltage overload stored in capacitor CL will undergo an exponential decay through the feedback network established by resistors R1 and R2. During the time interval between the removal of the output current load, and the appropriate response of the amplifier $A_1$, the output voltage remains unregulated. Meanwhile, if the load device consumes the output current, such as in a case of load current $I_{LOAD}$ transitioning between a light load and heavy load, the output current will only be supplied from the load capacitor $C_L$. This consequently decreases the output voltage $V_{OUT}$.

When the output voltage $V_{OUT}$ is lower than the desired voltage level, the regulator loop can be activated to restore the output voltage $V_{OUT}$ to the desired level. However, due to loop bandwidth limitations, the output voltage $V_{OUT}$ will supply an undershot voltage to the load device before the pass transistor $MP_X$ can be turned on. Moreover, in turning on the pass transistor $MP_X$ that is initially turned off, the large gate capacitance of the pass transistor $MP_X$ will consume a large amount current. This acts to further worsen the undershot output voltage $V_{OUT}$. An undershoot output voltage $V_{OUT}$ can therefore seriously hinder the operation of a load device.

U.S. Pat. No. 5,894,227 teaches a voltage regulator utilizing a comparator C1 to compare the gate voltage of the pass transistor and a reference voltage VTRIP in order to control a discharge transistor MPD. However, due to variations in fabrication processes, the reference voltage VTRIP may be set too high. This affects the operation of the discharge transistor MPD, and degrades the overall voltage regulation efficiency under a light load.

Other related art voltage regulators, such as that described in U.S. Pat. No. 5,966,004 and U.S. Pat. No. 6,201,375, utilize a regulator loop with an offset voltage to turn on the discharge transistor when the output voltage is higher than a reference voltage. Although the regulator loop may quickly discharge an initial output voltage, this voltage regulator still suffers from the same problem as described above. When the output voltage becomes lower than the reference voltage, the discharge path is identical to that mentioned in U.S. Pat. No 5,894,227. Since the discharge path still comprises a resistor network, recovery from an unregulated voltage condition may not be any faster due to the regulator loop.

SUMMARY

Therefore, it is an objective of the present invention to provide a linear voltage regulating circuit with undershoot minimization and a method thereof. This circuit is intended to quickly restore the output voltage from an overshoot condition, and to provide proper voltage regulation under normal operation.

According to an embodiment of the present invention, a voltage regulating circuit for providing a regulated output voltage is disclosed. The voltage regulating circuit comprises a linear voltage regulator having a first output producing the linear output voltage and a second output producing a pass voltage, a converting circuit for converting the pass voltage into a first current and a second current passing through a first converting node and a second converting node respectively, a capacitive device coupled to the first converting node, a first current mirror module comprising a first current mirror path coupled to the first converting node and a second current mirror path coupled to the second converting node, and a second current mirror module comprising a first current mirror path coupled to the second converting node and a second current mirror path coupled to the first output. The capacitive device is capable of maintaining the first current mirror module for a charging/discharging period to allow the output voltage to recover from an overshoot condition. The output will be restored into a regulated condition when a load device experiences a transition from a heavy load to light load.

These and other objectives of the claimed invention will no doubt become obvious to those of ordinary skill in the art after reading the following detailed description of the preferred embodiment that is illustrated in the various figures and drawings.

DETAILED DESCRIPTION

Certain terms are used throughout the description and following claims to refer to particular components. As one skilled in the art will appreciate, electronic equipment manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". Also, the term "couple" is intended to mean either an indirect or direct electrical connection. Accordingly, if one device is coupled to another device, that connection may be through a direct electrical connection, or through an indirect electrical connection via other devices and connections.

Figure 1:
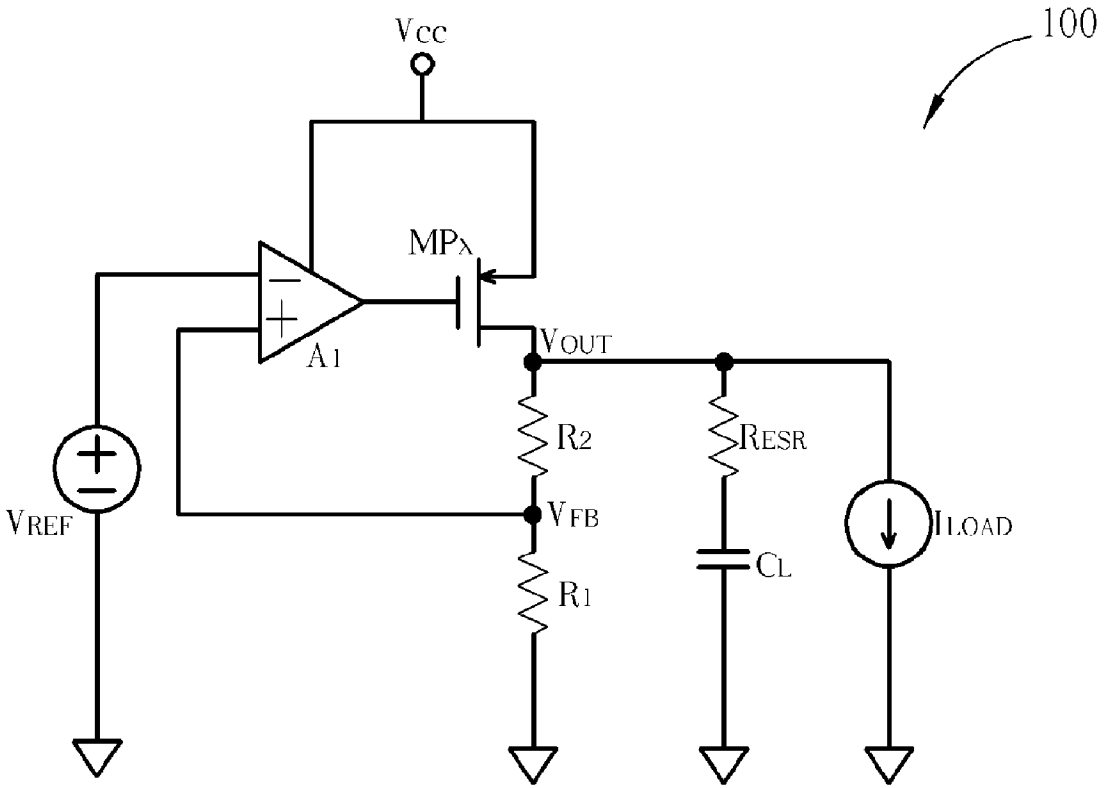
Fig. 1 Related Art
FIG. 1 is a voltage regulator of the related art.
Figure 2:
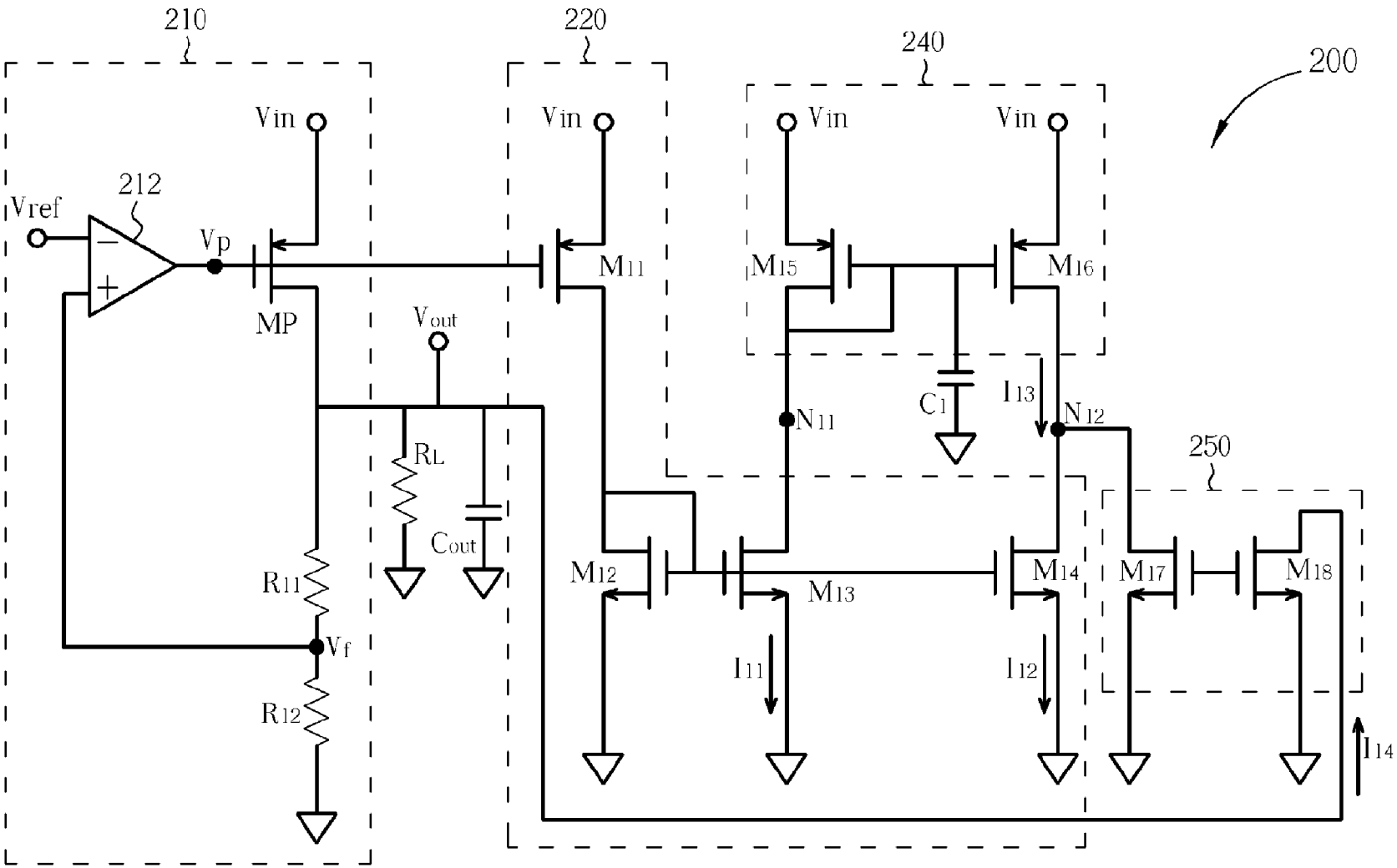
FIG. 2 illustrates a circuit diagram of a linear voltage regulating circuit according to a first embodiment of the present invention.

FIG. 2 illustrates a circuit diagram of a linear voltage regulating circuit 200 according to a first embodiment of the present invention. The linear voltage regulating circuit 200 comprises a linear regulator 210, a converting circuit 220, a capacitive device (in this embodiment the capacitive device is implemented by a capacitor $C_1$), a first current mirror module 240, and a second current mirror module 250. The linear regulator 210 comprises a pass transistor (PMOS transistor) MP having its drain connected to a voltage divider built by two resistors $R_{11}$, $R_{12}$, its source connected to a first reference voltage $V_{in}$, and its gate connected to an error amplifier 212. Additionally, a feedback circuit, as shown in FIG. 2, couples the output voltage $V_{out}$ and the error amplifier 212. Since the operation of the linear regulator 210 is well known to those skilled in this art, further description is omitted for brevity.

The converting circuit 220 comprises a plurality of transistors $M_{11}$, $M_{12}$, $M_{13}$, $M_{14}$, where transistor $M_{11}$ is a PMOS transistor and transistors $M_{12}$, $M_{13}$ and $M_{14}$ are NMOS transistors. As shown in FIG. 2, the gate of the transistor $M_{11}$ is connected to the gate of the pass transistor MP. Therefore, as the pass transistor MP is turned on from the pass voltage $V_p$, transistor $M_{11}$ will also turned on. In the converting circuit 220, the transistors $M_{12}$ and $M_{13}$ establish a current mirror to serve as a first current generator for a first current $I_{11}$, and transistors $M_{12}$ and $M_{14}$ establish another current mirror to serve as a second current generator for producing a second current $I_{12}$. In summary, the converting circuit 220 is used to convert the pass voltage $V_p$ into two currents $I_{11}$ and $I_{12}$, each flowing through a first and second converting node $N_1$ and $N_2$, respectively. The capacitive device, implemented by the capacitor $C_1$, has one of its ends coupled to the converting node $N_{11}$ and the other end coupled to ground. The capacitor $C_1$ is implemented to have a large capacitance. The first current mirror module 240, which mirrors the first current $I_{11}$ to generate a third current $I_{13}$, comprises two transistors $M_{15}$ and $M_{16}$, where transistor $M_{15}$ is diode-connected resulting in capacitor $C_1$ being coupled to the first converting node $N_{11}$. Please note that the current mirror ratios of the aforementioned current mirrors are properly designed such that the second current $I_{12}$ is greater than the third current $I_{13}$. Therefore, the voltage level at the second converting node $N_{12}$ is pulled down approximately to ground voltage due to the second current $I_{12}$, and transistors $M_{17}$ and $M_{18}$ in the second current mirror module 250 accordingly being turned off. In other words, as the pass transistor MP is turned on due to the pass voltage $V_p$, the second current mirror module 250 is disabled without mirroring any current.

A load device is coupled to the output of the linear regulator 210 and powered by the regulated output voltage $V_{out}$ and its accompanying output current. For simplicity, the load device is represented by an equivalent RC circuit, comprising a resistor $R_L$ and a capacitor $C_{out}$ coupled in parallel.

Under a load transient response of the linear regulator 210, when the transition from a heavy load to a light load occurs, the large output current that passes through the load device will suddenly decreases to become the small or zero output current. The current flowing through MP is forced to flow to the capacitor $C_{out}$, thus increasing $V_{out}$. Subsequently, $V_f$ also increases. However, due to the slew rate of the error amplifier 212, the pass voltage $V_p$ does not increase quickly enough in response to the increased feedback voltage $V_f$. Therefore, after a single loop delay, the error amplifier 212 produces a pass voltage $V_p$ high enough to turn off the pass transistor MP. It should be noted that the output voltage $V_{out}$ is charged to an overshoot output voltage immediately because of the loop delay time. As the pass transistor MP is turned off, transistors $M_{11}$, $M_{12}$, $M_{13}$, and $M_{14}$ are turned off accordingly. The diode-connected transistor $M_{15}$ and transistor $M_{16}$ in the first current mirror module 240, however, remain on and generate the third current $I_{13}$ due to the capacitive device (i.e. the capacitor $C_1$). Since transistor $M_{13}$ is turned off, the current passing through the transistor $M_{15}$ is forced to charge the capacitor $C_1$ via the current path built between the gate and drain of the transistor $M_{15}$.

According to the present invention, the value of capacitor $C_1$ is large enough to maintain the first current mirror module 240 being activated for a charging period. Because transistor $M_{14}$ is turned off, the voltage level at the second converting node $N_{12}$ is no longer pulled down to the ground voltage, and the second current mirror module 250 is activated to induce a discharge current $I_{14}$ in response to the received second current $I_{12}$. The discharge current $I_{14}$ then discharges the capacitor $C_{out}$ and regulates the output voltage $V_{out}$. In this embodiment, the discharge current $I_{14}$ is designed to be a percentage of the output current provided to the load device and is in proportion to the output current provided to the load device operating under a heavy load condition. This is because the larger the output current in heavy load condition, the higher the peak of the output voltage $V_{out}$ when the transition from heavy load to light load occurs. Therefore, since the discharge current $I_{14}$ depends upon the output current in heavy load condition, the linear voltage regulating circuit 200 can quickly recover from the undershoot condition to the under regulation condition. Please note that the capacitance of capacitor $C_1$ should be properly designed such that the second current mirror module 250 remains on until the output voltage $V_{out}$ has recovered from the overshoot status to the under regulation condition. After the charging period expires, transistors $M_{15}$ and $M_{16}$ are turned off because the gate voltage is pulled to approach $V_{in}$. Since there is no current flowing into the transistor $M_{17}$, discharge current $I_{14}$ is not induced and the linear voltage regulating circuit 200 enters into a steady light load condition.

Figure 3:
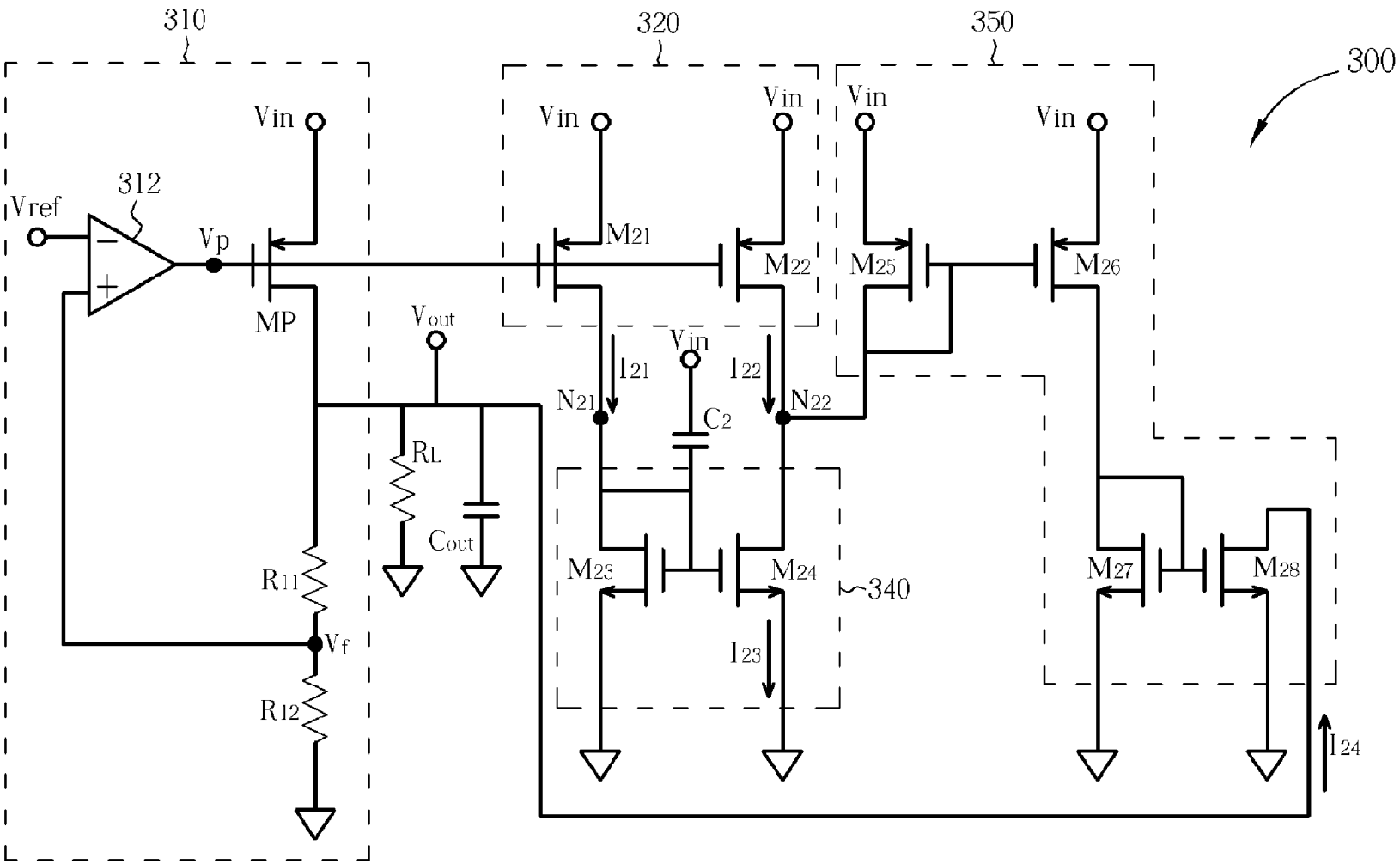
FIG. 3 illustrates a circuit diagram of a linear voltage regulating circuit according to a second embodiment of the present invention.

FIG. 3 illustrates a circuit diagram of a linear voltage regulating circuit 300 according to a second embodiment of the present invention. The linear voltage regulating circuit 300 comprises a linear regulator 310, a converting circuit 320, a capacitive device (in this embodiment the capacitive device is implemented by a capacitor $C_2$), a first current mirror module 340, and a second current mirror module 350. The configuration of the linear regulator 310 shown in FIG. 3 is identical to that of the linear regulator 210 shown in FIG. 2, and as such further description is omitted for brevity. In this embodiment, the converting circuit 320 comprises two transistors; (PMOS transistors) $M_{21}$ and $M_{22}$ coupled to a first converting node $N_{21}$ and a second converting node $N_{22}$ respectively. As shown in FIG. 3, the gates of the transistors $M_{21}$ and $M_{22}$ are both connected to the gate of the pass transistor MP. Therefore, as the pass transistor MP is turned on due to the pass voltage $V_p$, the transistors $M_{21}$ and $M_{22}$ are turned to pass a first current $I_{21}$ and a second current $I_{22}$ respectively. In short, the converting circuit 320 is used to convert the pass voltage $V_p$ into two currents, $I_{21}$ and $I_{22}$, each flowing through the first and second converting nodes $N_1$ and $N_2$ respectively.

The capacitive device, implemented by capacitor $C_2$, has one of its ends coupled to the first converting node $N_{21}$, and the other end coupled to a first reference voltage $V_{in}$. In addition, capacitor $C_2$ has large value capacitance. The first current mirror module 340, which mirrors the first current $I_{21}$ to generate a third current $I_{23}$, comprises two transistors $M_{23}$ and $M_{24}$, where the transistor $M_{23}$ is diode-connected to make capacitor $C_2$ coupled to the first converting node $N_{21}$. The current mirror ratio of the first current mirror module 340 is properly implemented such that the third current $I_{23}$ is smaller than the second current $I_{22}$. This results in the voltage level at the second converting node $N_{22}$ being pulled up to approximately that of the first reference voltage $V_{in}$ due to the second current $I_{22}$, and transistors $M_{25}$-$M_{28}$ in the second current mirror module 350 being turned off accordingly. In other words, as the pass transistor MP is turned on due to the pass voltage $V_p$, the second current mirror module 350 is disabled without mirroring any current.

Similar to the previous exemplary embodiment, the load device coupled to the output of the linear regulator 310 is represented by an equivalent RC circuit including a resistor $R_L$ and a capacitor $C_{out}$ coupled in parallel.

In the load transient response of the linear regulator 310, when the transition from a heavy load to light load occurs, a large output current passing through the load device suddenly decreases to become a small or zero output current. The current flowing through MP is forced to flow to the capacitor $C_{out}$, thus increasing $V_{out}$. Subsequently, $V_f$ also increases. However, due to the slew rate of the error amplifier 312, the pass voltage $V_p$ does not increase quickly enough to respond to the increased feedback voltage $V_f$. Therefore, after a single loop delay period, the error amplifier 312 will produce a pass voltage $V_p$ high enough to turn off the pass transistor MP. It should be noted that the output voltage $V_{out}$ is immediately charged to an overshoot output voltage because of the loop delay period. As the pass transistor MP is turned off, transistors $M_{21}$ and $M_{22}$ are also accordingly turned off. The diode-connected transistor $M_{23}$ and transistor $M_{24}$ in the first current mirror module 340 however still remain on, and generate a third current $I_{23}$ to the capacitive device (i.e. the capacitor $C_2$). Since transistor $M_{21}$ is turned off, the current passing through transistor $M_{23}$ is forced to discharge into capacitor $C_2$. According to the present invention, the capacitance of capacitor $C_2$ is large enough to maintain the first current mirror module 340 being on for the discharging period. Because transistor $M_{22}$ is turned off, the voltage level at the second converting node $N_{22}$ is no longer pulled up to the first reference voltage $V_{in}$, and the second current mirror module 350 is activated to induce a discharge current $I_{24}$ in response to the received second current $I_{23}$. The discharge current $I_{24}$ then discharges the capacitor $C_{out}$, and regulates the output voltage $V_{out}$. Similar to the design of the above embodiment, the discharge current $I_{24}$ is also configured to be proportional to the output current provided to the load device operating under a heavy load condition. As a result, the linear voltage regulating circuit 300 can quickly recover from the undershoot condition into the under regulation condition. Additionally, the capacitance of the capacitor $C_2$ should be properly designed such that the second current mirror module 350 remains on until the output voltage $V_{out}$ has recovered from the overshoot status to the under regulation condition. After the discharging period expires, the transistors $M_{23}$ and $M_{24}$ are turned off because the gate voltage is pulled down to approach the ground voltage. Since there is no current flowing into the transistor $M_{25}$, discharge current $I_{24}$ is not induced and the linear voltage regulating circuit 300 enters a steady light load condition.

The capacitive devices in the embodiments shown in FIG. 2 and FIG. 3, which require large capacitances, can be implemented by metal-insulator-metal (MiM) capacitors. However, larger capacitances require larger chip areas, which greatly increase the production cost. Therefore, the present invention further makes use of a capacitance boost technique for obtaining large capacitances using small chip area.

Figure 4:
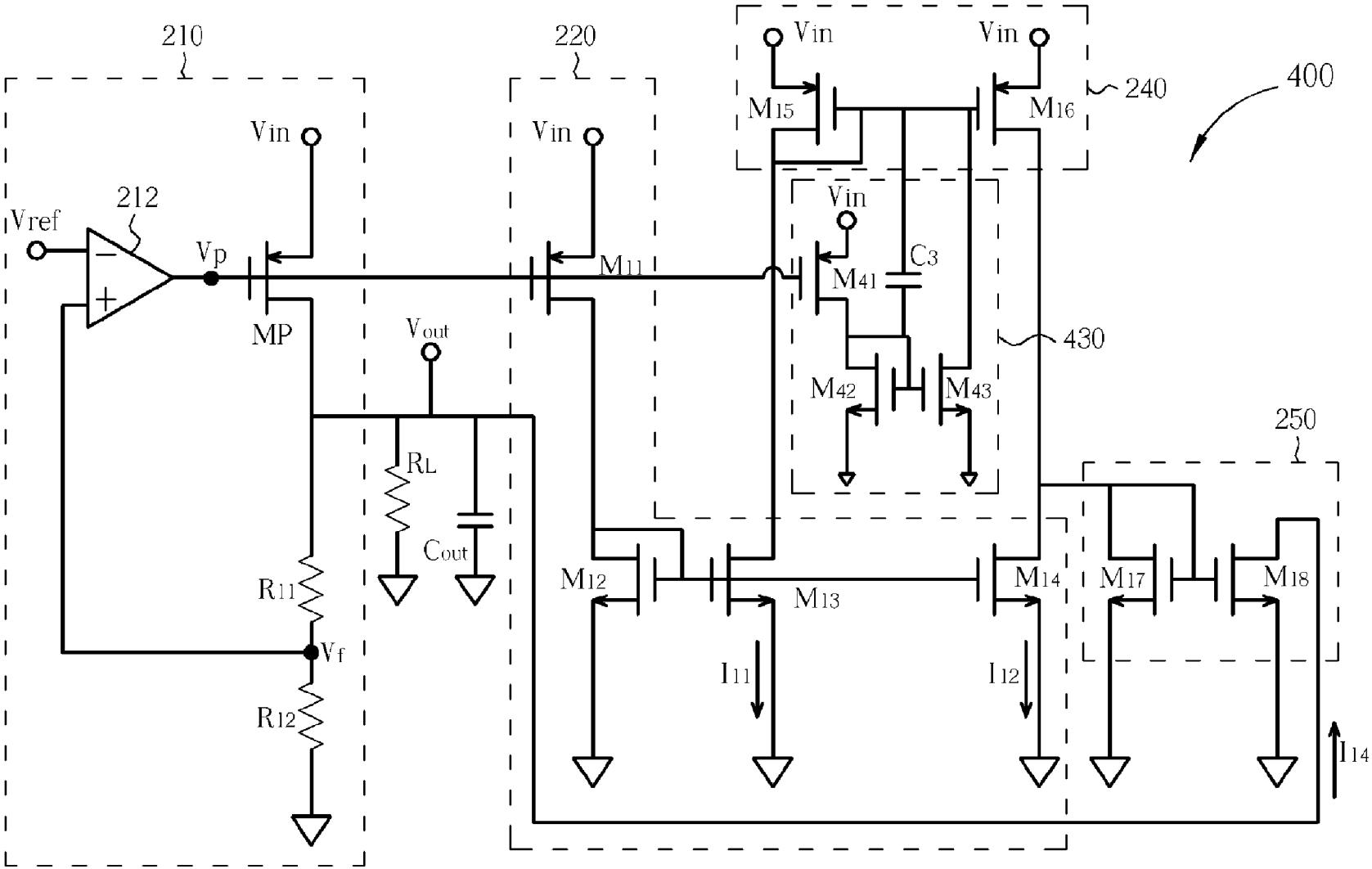
FIG. 4 illustrates a circuit diagram of a linear voltage regulating circuit according to a third embodiment of the present invention.

FIG. 4 illustrates a circuit diagram of a linear voltage regulating circuit 400 according to a third embodiment of the present invention. The linear voltage regulating circuit 400 comprises a linear regulator 210, a converting circuit 220, a capacitive device 430, a first current mirror module 240, and a second current mirror module 250. The linear voltage regulating circuit 400 shown in FIG. 4 appears similar to the linear voltage regulating circuit 200 shown in FIG. 2. The key difference is the inclusion of a capacitive device 430, which is not a single capacitor having a large capacitance value. In this embodiment, the capacitive device 430 includes a plurality of transistors $M_{41}$-$M_{43}$ and a capacitor $C_3$ having small capacitance, where the diode-connected transistor $M_{42}$ and the transistor $M_{43}$ form a current mirror. The aspect ratio (W/L) of the transistor $M_{42}$ is K1, and the aspect ratio (W/L) of the transistor $M_{43}$ is K2, where the ratio of K2/K1 is defined to be K (K>1) in order to implement the capacitance boost. The operation of the capacitance boost is detailed as follows.

In the load transient response of the linear regulator 210 of the linear voltage regulating circuit 400, during the transition from heavy load to light load, the boosted pass voltage $V_p$ acts to turn off transistor $M_{41}$. As described above, transistors $M_{15}$ and $M_{16}$ still remain on. In addition, transistors $M_{42}$ and $M_{43}$ are turned on to form a current mirror, where the current passing through transistor $M_{43}$ is K times as great as the current passing through transistor $M_{42}$. Since these two current mirror paths share the same current source, (i.e. the drain current outputted from the transistor $M_{15}$) the equivalent capacitive load viewed by the transistor $M_{15}$ is substantially equal to $(1+K)*C_3$. In this embodiment, K is defined to be significantly greater than one. The equivalent capacitive load viewed by transistor $M_{15}$ therefore is substantially equal to $K*C_3$. Please note that capacitor $C_3$ has a small capacitance such that the chip area for implementing the capacitive device 430 is small. Accordingly, the gate voltage of transistors $M_{15}$ and $M_{16}$ is slowly increased because of the large capacitance load of value $K*C_3$. Therefore, the capacitive device 430 is capable of maintaining the first current mirror module 240 being turned on during a charging period to allow the output voltage $V_{out}$ to recover from the overshoot condition into the under regulation condition. After the output voltage $V_{out}$ is restored to the under regulation condition, transistor $M_{41}$, which is a long-channel transistor, is turned on and its drain current becomes equal to the drain current of transistor $M_{42}$. As a result, no further current is provided to charge the capacitor $C_3$.

Figure 5:
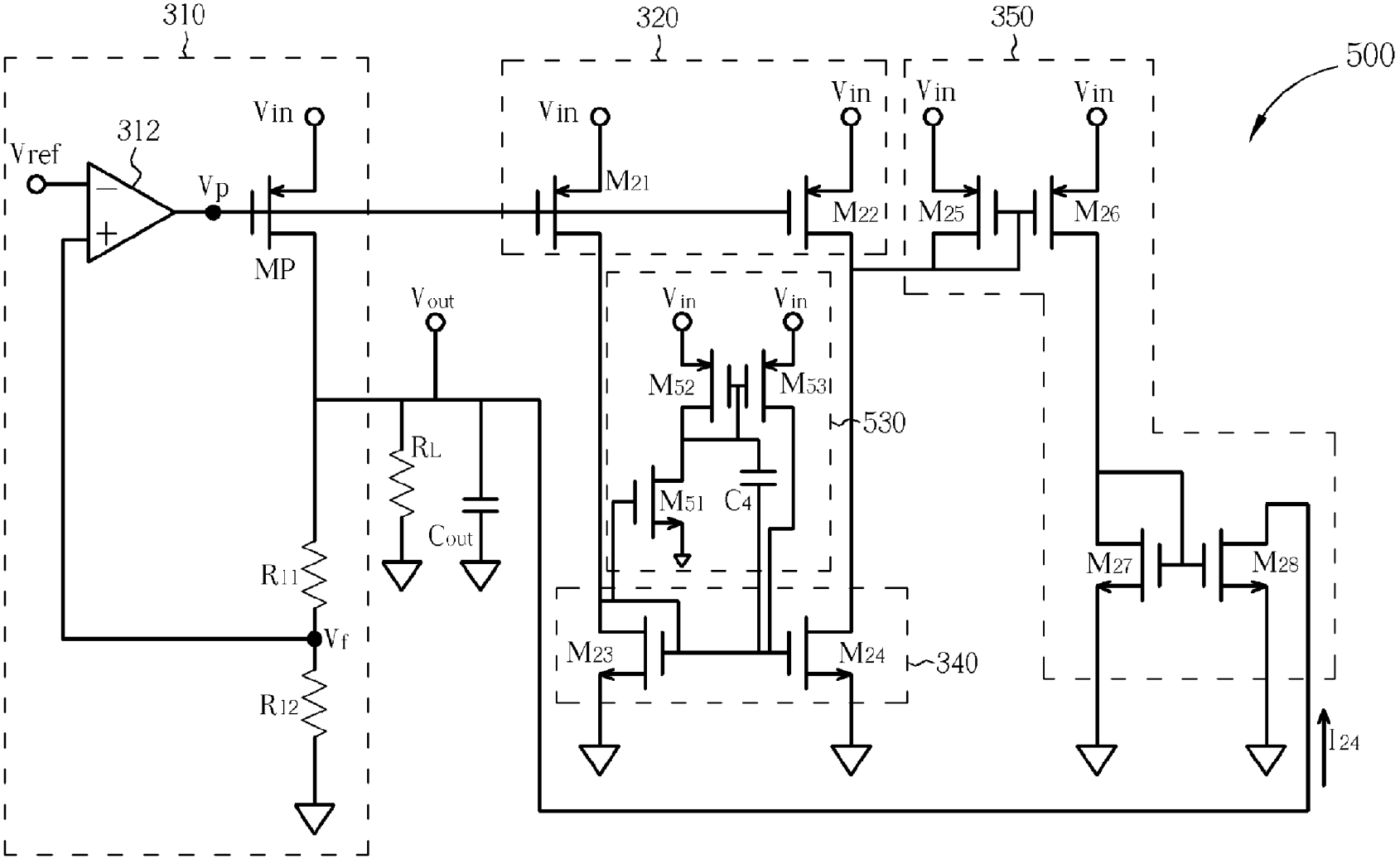
FIG. 5 illustrates a circuit diagram of a linear voltage regulating circuit according to a fourth embodiment of the present invention.

FIG. 5 illustrates a circuit diagram of a linear voltage regulating circuit 500 according to a fourth embodiment of the present invention. The linear voltage regulating circuit 500 comprises a linear regulator 310, a converting circuit 320, a capacitive device 530, a first current mirror module 340, and a second current mirror module 350. The linear voltage regulating circuit 500 shown in FIG. 5 is similar to the linear voltage regulating circuit 300 of FIG. 3. The key difference is the capacitive device 530, which is not simply a single capacitor having large capacitance. In this embodiment, the capacitive device 530 includes a plurality of transistors $M_{51}$-$M_{53}$, a capacitor $C_4$ having small capacitance, and a diode-connected transistor $M_{52}$ coupled to transistor $M_{53}$ which form a current mirror. The aspect ratio (W/L) of the transistor $M_{52}$ is K1, and the aspect ratio (W/L) of the transistor $M_{53}$ is K2, where the ratio of K2/K1 is defined to be K (K>1) in order to implement the capacitance boost. The operation of the capacitance boost is detailed as follows.

In the load transient response of the linear regulator 310 of the linear voltage regulating circuit 500, when the transition from a heavy load to a light load occurs, the boosted pass voltage $V_p$ turns off transistors $M_{21}$ and $M_{22}$. As described above, transistors $M_{23}$ and $M_{24}$ still remain on. As a result, the gate voltage of transistor $M_{51}$ is pulled down to approach ground voltage, causing transistor $M_{51}$ to turn off. However, transistors $M_{52}$ and $M_{53}$ are turned on to form a current mirror, where the current passing through the transistor $M_{53}$ is K times the current passing through the transistor $M_{52}$. Since these two current mirror paths share the same current source, (i.e. the drain current outputted from the transistor $M_{23}$) the equivalent capacitive load viewed by transistor $M_{23}$ is substantially equal to $(1+K)*C_4$. In this embodiment, K is defined to be significantly greater than one. The equivalent capacitive load viewed by the transistor $M_{15}$ therefore simplifies to approximate $K*C_4$. Please note that capacitor $C_4$ has a small capacitance such that the chip area for implementing the capacitive device 530 is small. Accordingly, the gate voltage of transistors $M_{23}$ and $M_{24}$ is slowly decreased because due to the large capacitance $K*C_4$. Therefore, the capacitive device 530 is capable of maintaining the first current mirror module 340 to remain on for the discharging period, allowing the output voltage $V_{out}$ to recover from the overshoot condition into the under regulation condition. After the output voltage $V_{out}$ enters the under regulation condition, transistor $M_{51}$, which is a long-channel transistor, is turned on and its source current becomes equal to the source current of transistor $M_{52}$. As a result, no current is provided to discharge capacitor $C_4$.

Please note that the circuit configurations of the above embodiments shown in FIG. 2 to FIG. 5 are only for illustrative purposes, and are not meant to provide limitations of the present invention.

Figure 6:
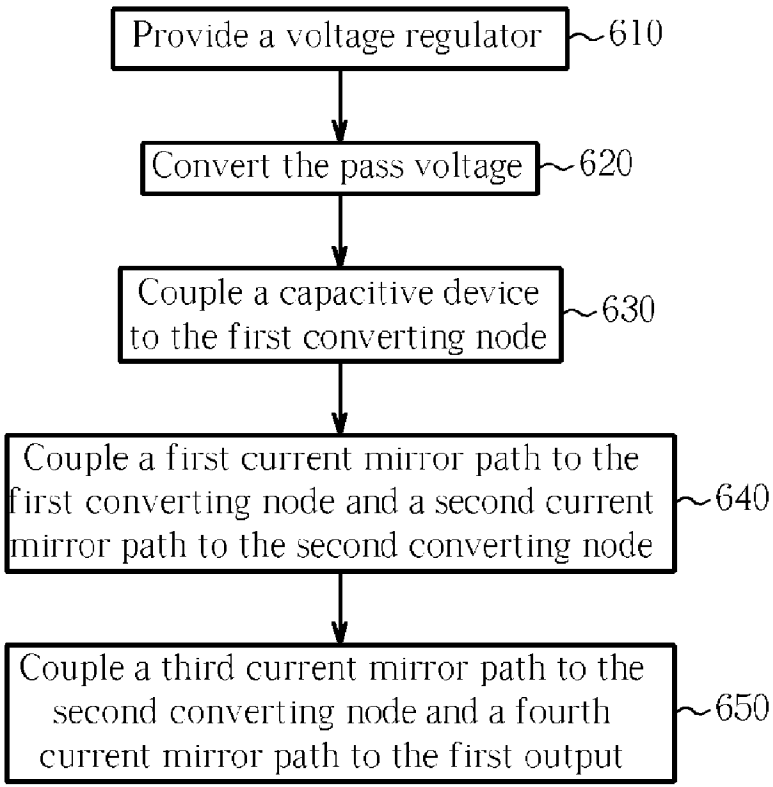
FIG. 6 is a flowchart illustrating a method for providing a regulated output voltage according to a fifth embodiment of the present invention.

A method for providing a regulated output voltage is further disclosed, as shown in FIG. 6, used to facilitate the device described above. Provided that substantially the same result is achieved, the steps of process 600 below need not be in the exact order shown and need not be contiguous, that is, other steps can be intermediate. The method comprises:

Step 610: Provide a voltage regulator having a first output producing the regulated output voltage and a second output producing a pass voltage;

Step 620: Convert the pass voltage into a first current and a second current, and pass the first current and the second current at a first converting node and a second converting node, respectively;

Step 630: Couple a capacitive device to the first converting node;

Step 640: Couple a first current mirror path to the first converting node and a second current mirror path to the second converting node, wherein the first current mirror path corresponds to the second current mirror path; and Step 650: Couple a third current mirror path to the second converting node and a fourth current mirror path to the first output, wherein the third current mirror path corresponds to the fourth current mirror path.

Briefly summarized, the present disclosure provides a capacitive device that is capable of maintaining a first current mirror module remaining on for a charging/discharging period, and a method thereof. This allows the output voltage to recover from an overshoot condition, and enter an under regulation condition when the load device has a transition from a heavy load to a light load.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A voltage regulating circuit for providing a regulated output voltage, comprising:

a voltage regulator having a first output producing the regulated output voltage and a second output producing a pass voltage;

a converting circuit, coupled to the voltage regulator, for converting the pass voltage into a first current and a second current, wherein the converting circuit has a voltage input node coupled to the second output for receiving the pass voltage, a first converting node, and a second converting node, the first current flows through the first converting node, and the second current flows through the second converting node;

a capacitive device coupled to the first converting node;

a first current mirror module comprising a first current mirror path coupled to the first converting node and a second current mirror path coupled to the second converting node; and a second current mirror module comprising a first current mirror path coupled to the second converting node and a second current mirror path coupled to the first output.

2. The voltage regulating circuit of claim 1 wherein the voltage regulator comprises:

an error amplifier having a first input coupled to a first reference voltage, a second input, and an error output coupled to the second output;

a pass transistor having a gate coupled to the second output, a first electrode coupled to a second reference voltage, and a second electrode coupled to the first output; and a feedback circuit coupled between the first output and the second input.

3. The voltage regulating circuit of claim 1 wherein the converting circuit further comprises:

a transistor having a gate coupled to the second output, a first electrode coupled to a reference voltage, and a second electrode;

a first current generator, coupled to the first converting node and the second electrode, for generating the first current; and a second current generator, coupled to the second converting node and the second electrode, for generating the second current.

4. The voltage regulating circuit of claim 3 wherein the first and second current generators are current mirrors having a common diode-connected transistor.

5. The voltage regulating circuit of claim 1 wherein the capacitive device is a single capacitor.

6. The voltage regulating circuit of claim 1 wherein the capacitive device comprises:

a third current mirror module comprising a first current mirror path, and a second current mirror path coupled to the first converting node, wherein a current mirror ratio of the second current mirror path of the third current mirror module to the first current mirror path of the third current mirror module is greater than one;

a capacitor, coupled between the first current mirror path of the third current mirror module and the first converting node; and a transistor having a gate coupled to the second output, a first electrode coupled to a reference voltage, and a second electrode coupled to the first current mirror path of the third current mirror module.

7. The voltage regulating circuit of claim 6 wherein the transistor is a long-channel transistor.

8. The voltage regulating circuit of claim 1 wherein the converting circuit comprises:

a first transistor having a gate coupled to the second output, a first electrode coupled to a reference voltage, and a second electrode coupled to the first converting node; and a second transistor having a gate coupled to the second output, a first electrode coupled to the reference voltage, and a second electrode coupled to the second converting node.

9. The voltage regulating circuit of claim 1 wherein the capacitive device comprises:

a third current mirror module comprising a first current mirror path, and a second current mirror path coupled to the first converting node, wherein a current mirror ratio of the second current mirror path of the third current mirror module to the first current mirror path of the third current mirror module is greater than one;

a capacitor, coupled between the first current mirror path of the third current mirror module and the first converting node; and a transistor having a gate coupled to the first converting node, a first electrode coupled to a reference voltage, and a second electrode coupled to the first current mirror path of the third current mirror module.

10. The voltage regulating circuit of claim 9 wherein the transistor is a long-channel transistor.

11. The voltage regulating circuit of claim 1 wherein the second current is greater than the first current.

12. A method for providing a regulated output voltage, comprising:

(a) providing a voltage regulator having a first output producing the regulated output voltage and a second output producing a pass voltage;

(b) converting the pass voltage into a first current and a second current, and passing the first current and the second current at a first converting node and a second converting node, respectively;

(c) coupling a capacitive device to the first converting node;

(d) coupling a first current mirror path to the first converting node and a second current mirror path to the second converting node, wherein the first current mirror path corresponds to the second current mirror path; and (e) coupling a third current mirror path to the second converting node and a fourth current mirror path to the first output, wherein the third current mirror path corresponds to the fourth current mirror path.

13. The method of claim 12 wherein step (b) is performed by:

providing a transistor having a gate coupled to the second output;

mirroring a current passing through the first transistor to generate the first current; and mirroring the current passing through the first transistor to generate the second current.

14. The method of claim 12 wherein the capacitive device is a single capacitor.

15. The method of claim 12 wherein step (c) further comprises:

providing the capacitive device a current mirror module comprising a first current mirror path, and a second current mirror path coupled to the first converting node, wherein a current mirror ratio of the second current mirror path of the current mirror module to the first current mirror path of the current mirror module is greater than one;

providing the capacitive device a capacitor, coupled between the first current mirror path of the current mirror module and the first converting node;

enabling the current mirror module for charging/discharging the capacitor when the regulated output voltage enters an overshoot condition; and stopping the current mirror module from charging/discharging the capacitor when the regulated output voltage enters an under regulation condition.

16. The method of claim 12 wherein step (b) is performed by:

providing a first transistor, having a gate coupled to the second output, for outputting the first current; and providing a second transistor, having a gate coupled to the second output, for outputting the second current.

17. The method of claim 16 wherein step (c) further comprises:

providing the capacitive device a current mirror module comprising a first current mirror path, and a second current mirror path coupled to the first converting node, wherein the current mirror ratio of the second current mirror path of the current mirror module to the first current mirror path of the current mirror module is greater than one;

providing the capacitive device a capacitor, coupled between the first current mirror path of the current mirror module and the first converting node;

enabling the current mirror module for charging/discharging the capacitor when the regulated output voltage enters a overshoot condition; and stopping the current mirror module from charging/discharging the capacitor when the regulated output voltage enters an under regulation condition.

18. The method of claim 12 wherein the second current is greater than the first current.

* * * * *